US007654305B2

(12) United States Patent
Hirao

(10) Patent No.: US 7,654,305 B2
(45) Date of Patent: Feb. 2, 2010

(54) DIE FOR DIE CASTING, METHOD OF MANUFACTURING CAST PRODUCT, AND CAST PRODUCT

(75) Inventor: Hiroaki Hirao, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/244,634

(22) Filed: Oct. 2, 2008

(65) Prior Publication Data

US 2009/0151889 A1 Jun. 18, 2009

(30) Foreign Application Priority Data

Dec. 14, 2007 (JP) ..... 2007-323945

(51) Int. Cl.
*B22D 17/08* (2006.01)
*B22D 17/20* (2006.01)

(52) U.S. Cl. ..... 164/113; 164/312

(58) Field of Classification Search ..... 164/113, 164/312

See application file for complete search history.

(56) References Cited

U.S. PATENT DOCUMENTS

| | | | |
|---|---|---|---|
| 6,819,547 | B2 | 11/2004 | Minaguchi et al. |
| 2002/0126445 | A1 | 9/2002 | Minaguchi et al. |

FOREIGN PATENT DOCUMENTS

| | | | |
|---|---|---|---|
| JP | 2-91770 | | 3/1990 |
| JP | 4-357569 | | 12/1992 |
| JP | 04-367359 | | 12/1992 |
| JP | 08-90211 | | 4/1996 |
| JP | 08-90211 | | 9/1996 |
| JP | 2000-280055 | | 10/2000 |
| JP | 2001-9562 | | 1/2001 |
| JP | 2002-011546 | * | 1/2002 |
| JP | 2002-045956 | | 2/2002 |
| JP | 2002-263820 | | 9/2002 |
| JP | 3427060 | | 7/2003 |
| JP | 2004-291063 | | 10/2004 |
| JP | 2007-326114 | | 12/2007 |
| JP | 2008-114408 | | 5/2008 |
| WO | WO 2008-053946 | | 5/2008 |

OTHER PUBLICATIONS

Japanese Patent Application No. 2007-335286 Office Action mailed Dec. 16, 2008 (English Translation).
Japanese Patent Application No. 2007-323945 Office Action mailed Dec. 16, 2008 (English Translation).

* cited by examiner

*Primary Examiner*—Kuang Lin
(74) *Attorney, Agent, or Firm*—Blakely, Sokoloff, Taylor & Zafman LLP

(57) ABSTRACT

According to one embodiment, a die includes a stationary die, and a movable die. A fin section provided between a runner section and a product section is extended from one end part to the other end part of the product section in a direction intersecting a stream direction of molten metal, and includes a fin central section opposed to a biscuit section in the stream direction of the molten metal, and a fin side section on a side of the fin central section. The fin side section includes a fin thick part formed thicker than a thickness of the fin central section. The fin thick part is extended to a boundary between the fin section and the product section. The product section includes a product thick part connected to the fin thick part in a region opposed to the fin thick part.

9 Claims, 6 Drawing Sheets

DIE FOR DIE CASTING, METHOD OF MANUFACTURING CAST PRODUCT, AND CAST PRODUCT

CROSS-REFERENCE TO RELATED APPLICATIONS

This application is based upon and claims the benefit of priority from Japanese Patent Application No. 2007-323945, filed Dec, 14, 2007, the entire contents of which are incorporated herein by reference.

BACKGROUND

1. Field

One embodiment of the present invention relates to a technique associated with die casting.

2. Description of the Related Art

A die-casting die of the cold-chamber die casting system is provided with a fan gate for guiding molten metal to a product section (i.e., section in which a product is to be cast) inside the die. The fan gate includes a biscuit section for receiving molten metal from an injection apparatus of a casting machine, a runner section for guiding the molten metal from the biscuit section to the product section, and a fin section for accelerating the flow speed of the molten metal by sharply reducing the thickness.

The product section includes a product central section corresponding to a region straightly downstream from the biscuit section in the direction of the flow of the molten metal, and product side sections out of the product central section. The fan gate is provided with a delta section for supplying the flow of the molten metal liable to concentrate in the product central section to the product side sections This delta section is a convex section provided, for example, between the biscuit section and the product central section. The molten metal flowing from the biscuit section toward the product central section collides against the delta section to be apportioned to the right and left product side sections. if the delta section is not provided, the flow of the molten metal concentrates in the product central section, and the product central section becomes overfilled. On the other hand, in the right and left product side sections, there is the possibility of shortage of filling, uneven filling, or a crack being caused resulting from incomplete fusion.

In Jpn. Pat. Appln. KOKAI Publication No. 2002-45956, a fan gate of a die provided with a delta section is disclosed. This fan gate includes a biscuit section, runner section, and gate sections (corresponding to the fin section). The runner section is partially provided with the gate sections, and only several specific parts of the runner section are connected to the product section. In other words, parts which are not provided with the gate sections serve as delta sections.

By the way, when such a delta section is provided, the molten metal liable to concentrate in the product central section is caused to branch into the product side sections, and the shortage of filling at the product side sections is improved. However, the molten metal divided by the delta section is joined together in the product section again, and in that process, collision between the molten metal components occurs. At this time, there is the possibility of a phenomenon in which air inside the die is rolled up in the molten metal (so-called gas inclusion) being caused. If this gas inclusion occurs, there is the possibility of defective casting called a mold cavity, defective filling, or a molten metal wrinkle being caused. The molten metal wrinkle is also called cold shut, which is a pattern left on the surface of a cast product.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Figure 1:
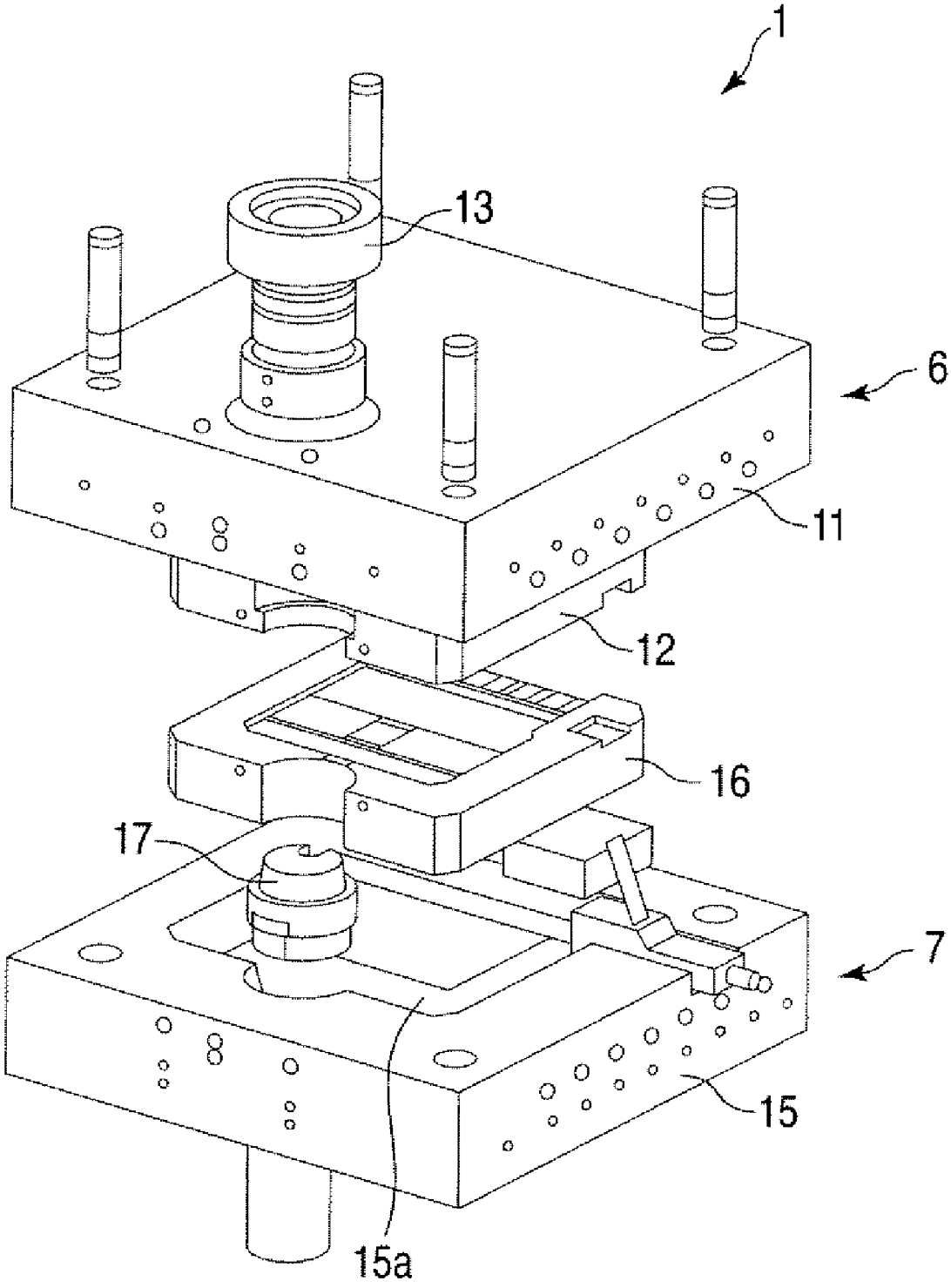
FIG. 1 is an exemplary perspective view showing a die according to an embodiment of the present invention in a disassembling manner.

Various embodiments according to the invention will be described hereinafter with reference to the accompanying drawings. In general, according to one embodiment of the invention, a die for die casting comprises a stationary die, and a movable die to be combined with the stationary. When the movable die is combined with the stationary die, a biscuit section into which molten metal is to be infused, a product section in which a product is to be cast, a runner section which guides the molten metal from the biscuit section toward the product section, and a fin section which is provided between the runner section and the product section, and in which a thickness of the fin section decreases in a direction closer to the product section are formed between the stationary die and the movable die. The fin section is extended from one end part to the other end part of the product section in a direction intersecting a stream direction of the molten metal, and includes a fin central section opposed to the biscuit section in the stream direction of the molten metal, and a fin side section on a side of the fin central section. The fin side section is provided with a fin thick part formed thicker than a thickness of the fin central section, and the fin thick part is extended to a boundary between the fin section and the product section. A product thick part connected to the fin thick part in a region of the product section opposed to the fin thick part.

According to one embodiment of the invention, in a method of manufacturing a cast product by die casting, a die including a stationary die and a movable die to be combined with the stationary die is prepared. In the die, when the movable die is combined with the stationary die, a biscuit section into which molten metal is to be infused, a product section in which the cast product is to be cast, a runner section which guides the molten metal from the biscuit section toward the product section, and a fin section which is provided between the runner section and the product section, and in which a thickness of the fin section decreases in a direction closer to the product section are formed between the stationary die and the movable die. The fin section is extended from one end part to the other end part of the product section in a direction intersecting a stream direction of the molten metal, and includes a fin central section opposed to the biscuit section in the stream direction of the molten metal, and a fin side section on a side of the fin central section. The fin side section is provided with a fin thick part formed thicker than a thickness of the fin central section, and the fin thick part is extended to a boundary between the fin section and the product section. A product thick part connected to the fin thick part is provided in a region of the product section opposed to the fin thick part. Further, the movable die is combined with the stationary die, and then the molten metal is infused into the biscuit section.

According to one embodiment of the invention, a cast product is cast by using a die comprising a stationary die and a movable die to be combined with the stationary die. When the movable die is combined with the stationary die, a biscuit section into which molten metal is to be infused, a product section in which the cast product is to be cast, a runner section which guides the molten metal from the biscuit section toward the product section, and a fin section which is provided between the runner section and the product section, and in which a thickness of the fin section decreases in a direction closer to the product section are formed between the stationary die and the movable die. The fin section includes a fin central section corresponding to a region straightly downstream from the biscuit section in a stream direction of the molten metal, and a fin side section on a side of the fin central section. The fin side section is provided with a fin thick part formed thicker than a thickness of the fin central section, and the fin thick part is extended to a boundary between the fin section and the product section. A product thick part connected to the fin thick part is provided in a region of the product section opposed to the fin thick part.

A die 1, a method of manufacturing a cast product, and a cast product 2 according to an embodiment of the present invention will be described below with reference to FIGS. 1 to 9.

FIG. 1 shows the die 1 according to the embodiment. The die 1 is used for, for example, die casting of the cold chamber system. For example, a magnesium alloy, aluminum alloy, or zinc ally is poured into this die 1 as molten metal by pressure. Incidentally, the die according to the present invention is not limited to the above materials, and can be widely used for die casting in which various materials are used as molten metal.

Figure 9:
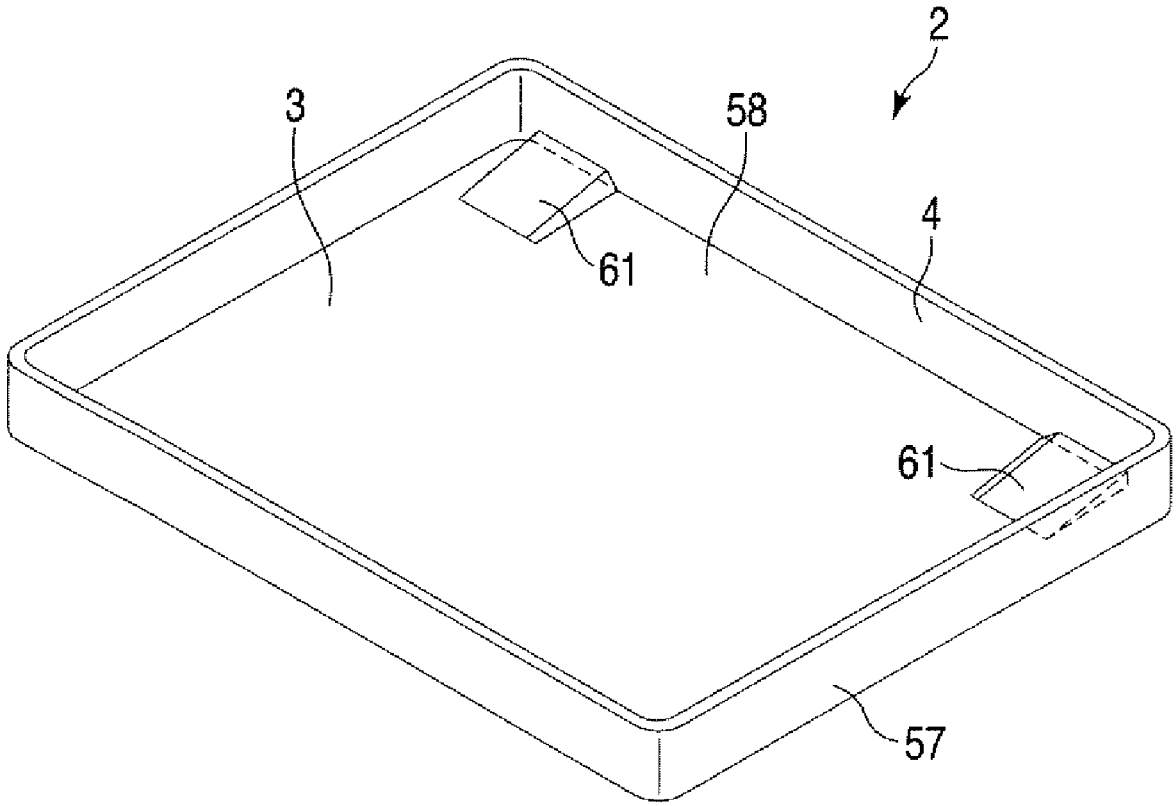
FIG. 9 is an exemplary perspective view of a cast product according to the embodiment of the present invention.

FIG. 9 shows an example of a cast product 2 which is a product cast by using the die 1. The cast product 2 is provided with a bottom wall 3 having, for example, a rectangular shape, a vertical wall 4 rising from the peripheral edge part of the bottom wall 3, and a box-like shape opened on one side. The cast product 2 is, for example, a component constituting a part of a housing of an electronic apparatus such as a portable computer. Incidentally, the cast product to which the present invention can be applied is not limited to the above example, and various components widely correspond thereto.

As shown in FIG. 1, the die 1 includes a stationary die 6, and a movable die 7 to be combined with the stationary die 6. The stationary die 6 is fixed to a stationary platen (not shown). The stationary die 6 includes a stationary die plate 11, a cavity member 12, and an inlet member 13.

The stationary die plate 11 is fixed to the stationary platen, and is provided with a recess part (not shown) to which the cavity member 12 is mounted on a surface opposed to the movable die 7. The cavity member 12 is attached to the recess part, and is opposed to the movable die 7. The cavity member 12 includes a die surface for forming, for example, an outer surface of the product. Incidentally, the "outer surface" implies a surface of a cast product 2 that can be seen by a user when the product 2 has become a part of a final product. The inlet member 13 is provided with a through-hole into which an injection plunger of the casting machine is inserted, and is formed into a cylindrical shape.

On the other hand, the movable die 7 includes a movable die plate 15, a core member 16, and a dividing piece 17.

The movable die 7 is fixed to a movable platen (not shown), and can be advanced or retreated between a die closed position in which the movable die 7 is combined with the stationary die 6, and a die opened position in which the movable die 7 is separated from the stationary die 6.

The movable die plate 15 fixed to movable platen, and is provided with a recess part 15*a* to which the core member 16 is mounted on a surface opposed to the stationary die 6. The core member 16 is attached to the recess part 15*a*, and is opposed to the stationary die 6. The core member 16 includes a die surface for forming, for example, an inner surface of the product. Incidentally, the "inner surface" implies a surface on the inner side of the cast product 2 that is not seen by the user when the product 2 has become a part of the final product.

Figure 2:
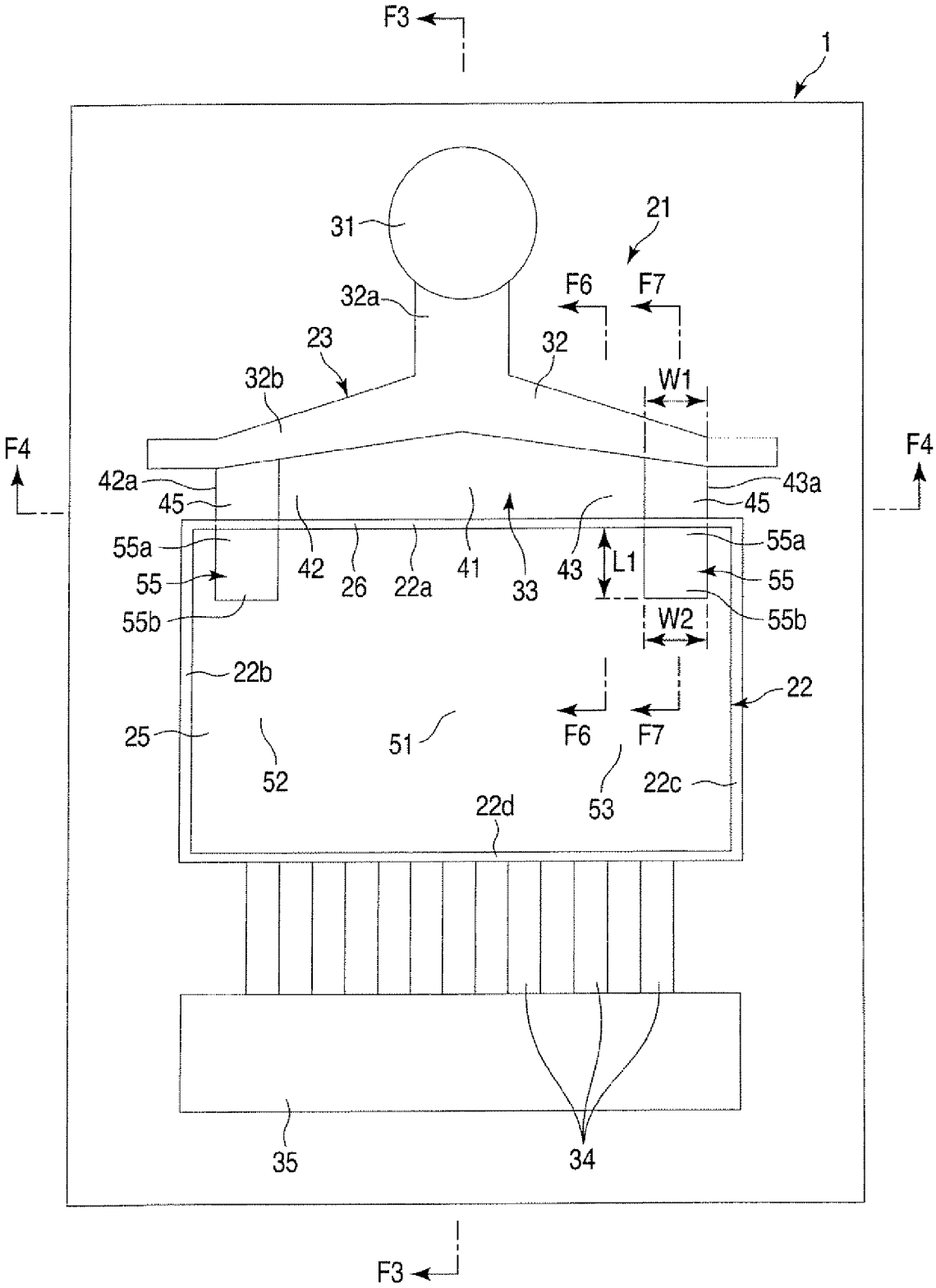
FIG. 2 is an exemplary view schematically showing the structure of an internal space of the die shown in FIG. 1.

When the movable die 7 is combined with the stationary die 6, an internal space 21 into which molten metal is pressed is formed between the stationary die 6 and the movable die 7. In FIGS. 2 to 8, the internal space 21 into which the molten metal flows is extracted from the die 1 to be schematically shown for convenience of explanation. In FIG. 2, the molten metal flows from above to below Incidentally, in this description, when simply the term "upstream side" is used, it implies the upstream side in the direction of the flow of the molten metal, and when simply the term "downstream side" is used, it implies the downstream side in the direction of the flow of the molten metal (i.e., the downstream side of the molten metal).

Figure 3:
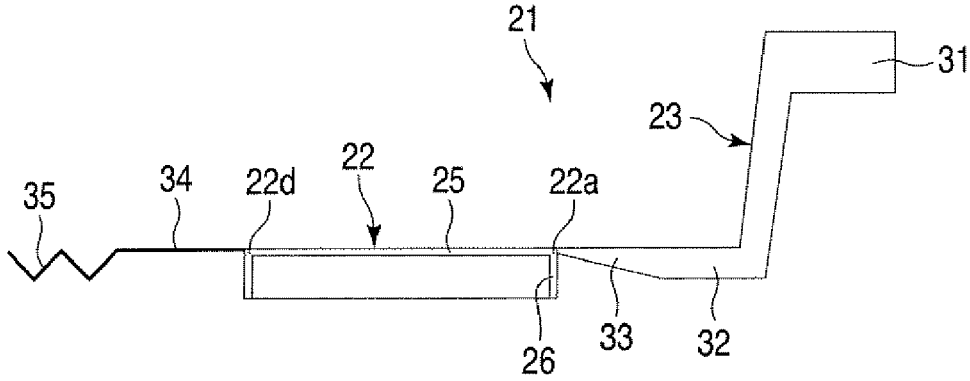
FIG. 3 is an exemplary view schematically showing a cross section of an internal space of the die shown in FIG. 2 taken along line F3-F3.
Figure 6:
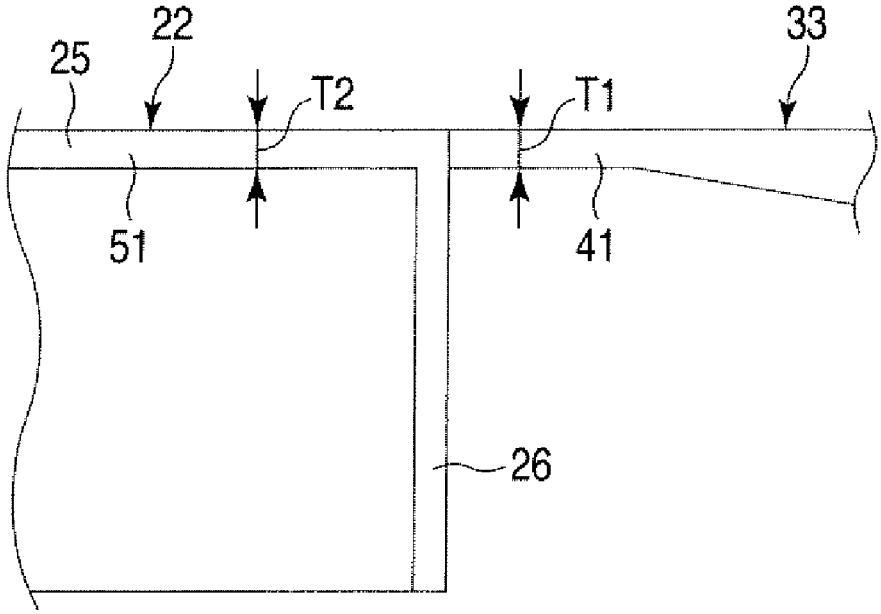
FIG. 6 is an exemplary view schematically showing a cross section of the boundary part between the fin section and the product section shown in FIG. 2 taken along line F6-F6.

As shown in FIG. 2, the internal space 21 in the die 1 includes a product section 22 which is a space in which a product (i.e., the cast product 2) is to be cast, and a fan gate 23 for guiding the molten metal to the product section 22. The product section 22 includes an engraved surface corresponding to the shape of the cast product 2. As shown in FIGS. 3 and 6, the product section 22 includes a bottom wall section 25 which is a space in which the bottom wall 3 of the cast product 2 is to be cast, and a vertical wall section 26 which is a space in which the vertical wall 4 of the cast product 2 is to be cast.

Here, a term "standard thickness" is defined. The "standard thickness" is also called a fundamental thickness, is a thickness that is generally taken up most widely in the cast product, and is a thickness which is the reference of the product. In the case of the cast product 2 described above, the thickness of the bottom wall 3 corresponds to the standard thickness mentioned in the present invention. That is, the thickness of the bottom wall section 25 of the product section 22 in which the bottom wall 3 is to be cast is equal to the standard thickness.

As shown in FIG. 2, the product section 22 includes first to fourth edge sections 22*a*, 22*b*, 22*c*, and 22*d* corresponding to the four sides of the cast product 2. The first edge section 22*a* is positioned on the most upstream side of the product section 22, and extends in the direction (lateral direction in FIG. 2) intersecting the stream direction of the molten metal. The second and third edge sections 22*b* and 22*c* extend from both side ends of the first edge section 22*a* in the flow direction (longitudinal direction in FIG. 2) of the molten metal. The fourth edge section 22*d* is positioned on the most downstream side of the product section 22, and extends in the direction intersecting the stream direction of the molten metal.

The fan gate 23 for guiding the molten metal to the product section 22 includes, in the order from the upstream side, a biscuit section 31, a runner section 32, and a fin section 33 as shown in FIG. 2. The biscuit section 31 is a section which is provided inside the inlet member 13, and receives the molten metal from the injection apparatus of the casting machine at a high temperature and at a high speed. That is, the molten metal is to be infused (i.e., poured) into the biscuit section 31.

The runner section 32 is a section which continues from the biscuit section 31, and guides the molten metal ejected into the biscuit section 31 toward the product section 22. As shown in FIG. 2, the runner section 32 includes an upstream section 32*a* communicating with the biscuit section 31, and a downstream section 32*b* communicating with the fin section 33.

The downstream section 32*b* of the runner section 32 is expanded larger than the upstream section 32*a* so that the molten metal can be guided to the entirety of the product section 22. As shown in FIG. 2, the downstream section 32*b* of the runner section 32 is expanded to be opposed to, for example, the most part of the first edge section 22*a* of the product section 22.

The fin section 33 is provided between the runner section 32 and the product section 22. As shown in FIG. 3, the fin section 33 is a section in which a thickness of the fin section 33 decreases sharply in the direction closer to the product section 22 in the stream direction of the molten metal, and which accelerates the flow speed of the molten metal toward the product section 22. Incidentally, the fin section 33 will be described later in detail.

As shown in FIG. 2, an overflow section 34, and a chillvent section 35 are provided on the downstream side of the product section 22. The overflow section 34 is a section for exhausting air inside the product section 22 pushed out by the molten metal to reduce filling resistance of the molten metal, and pushing out a part of the molten metal a flow tip of which is deteriorated to the outside of the product section 22. The chillvent section 35 is a section for preventing the deteriorated molten metal from running out of the die 1.

Next, the fin section 33 according to this embodiment will be described below in detail.

As shown in FIG. 2, the fin section 33 according to this embodiment is connected to the only one edge section 22*a*. The fin section 33 is one body extending, in its entirety, from one end part to the other end part of the product section 22 in the direction intersecting the stream direction of the molten metal. That is, the fin section 33 does not partly connect the runner section 32 to the product section 22, and connects substantially the entire downstream end of the runner section 32 to the product section 22.

Incidentally, "provided to extend from one end part to the other end part of the product section" is not limited to the case where the fin section is provided strictly from one end edge to the other end edge of the product section, and includes the case where the fin section extends from, for example, a region in the vicinity of one end of the product section to a region in the vicinity of the other end thereof as shown in FIG. 2.

As shown in FIG. 2, the fin section 33 includes a fin central section 41, and fin side sections 42 and 43 provided on both sides of the fin central section 41. The fin central section 41 is a region opposed to the biscuit section 31 in the stream direction of the molten metal. Incidentally, in this present invention, "opposed to the biscuit section" implies opposing the biscuit section when the internal space of the die is viewed as a plan view. The fin central section 41 corresponds to a region straightly downstream from the biscuit section 31 in the stream direction of the molten metal, into which the molten metal flows straightly from the biscuit section 31.

As shown in FIG. 6, the thickness T1 of the fin central section 41 is set equal to the thickness T2 (that is, the standard thickness of the product section 22) of the bottom wall section 25 of the product section 22. The fin central section 41 is provided on the extension line of the bottom wall section 25 of the product section 22, and is directly connected to the bottom wall section 25.

On the other hand, as shown in FIG. 2, the fin side sections 42 and 43 are regions out of the fin central section 41, and are not opposed to the biscuit section 31. As shown in FIG. 2, the pair of fin side sections 42 and 43 is formed on both the lateral sides of the fin central section 41. The fin side sections 42 and 43 extend in the stream direction of the molten metal.

Figure 4:
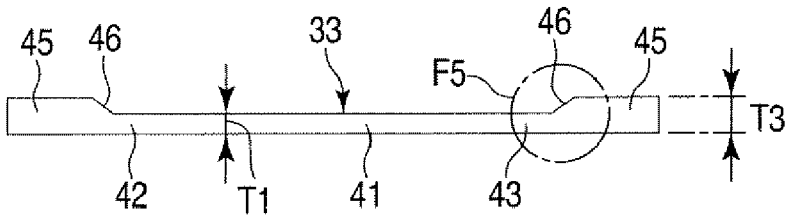
FIG. 4 is an exemplary view schematically showing a cross section of the fin section shown in FIG. 2 taken along line F4-F4.

As shown in FIGS. 2 and 4, a fin thick part 45 is provided in a partial region of each of the pair of fin side sections 42 and 43. As shown in FIG. 4, the fin thick part 45 is a thickness-increased part having a thickness T3 thicker than the thickness T1 of the fin central section 41.

As shown in FIG. 2, the fin thick part 45 is extended in the stream direction of the molten metal, and is provided to be extended from the runner section 32 to the product section 22. That is, fin thick part 45 is extended to the boundary between the fin section 33 and the product section 22. The fin thick sections 45 are provided at side edge sections 42*a* and 43*a* of the fin section 33 which extend in the stream direction of the molten metal, i.e., at parts of the fin section 33 farthest from the fin central section 41.

Figure 7:
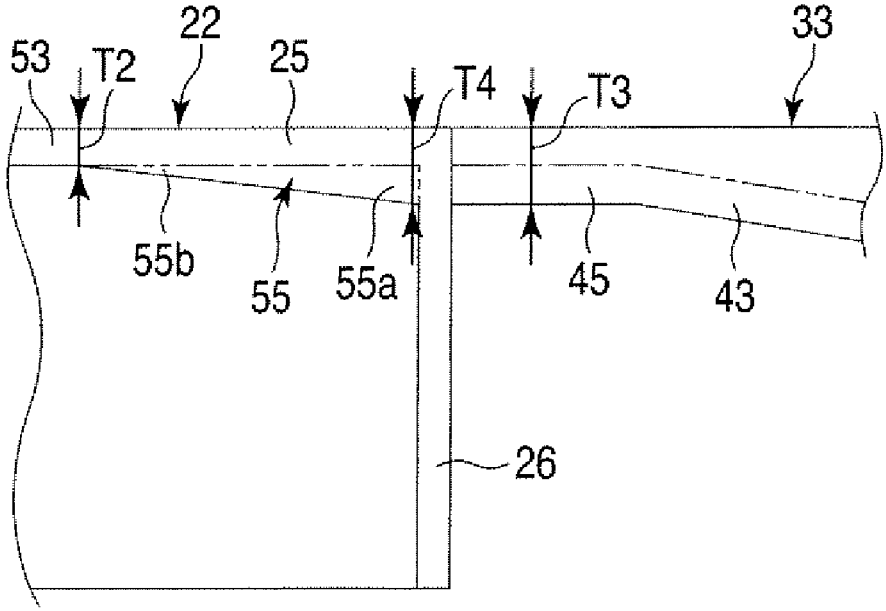
FIG. 7 is an exemplary view schematically showing a cross section of the boundary part between the fin section and the product section shown in FIG. 2 taken along line F7-F7.

The thickness T3 of the fin thick part 45 is a thickness, for example, 1.1 to 1.5 times the thickness T1 of the fin central section 41. Incidentally, the thickness of the fin thick part 45 may be made larger than the above thickness depending on the product shape. As shown in FIG. 7, the fin thick part 45 is swelled with respect to the fin central section 41 in the direction in which the vertical wall section 26 raises from the bottom wall section 25.

As shown in FIG. 2, for example, in the case where the cast product 2 is a housing component of a portable computer of the A4-size, the width W1 of the fin thick part 45 in the direction intersecting the stream direction of the molten metal is, for example, about 30 mm. Incidentally this numerical value does not limit the range of the present invention.

Figure 5:
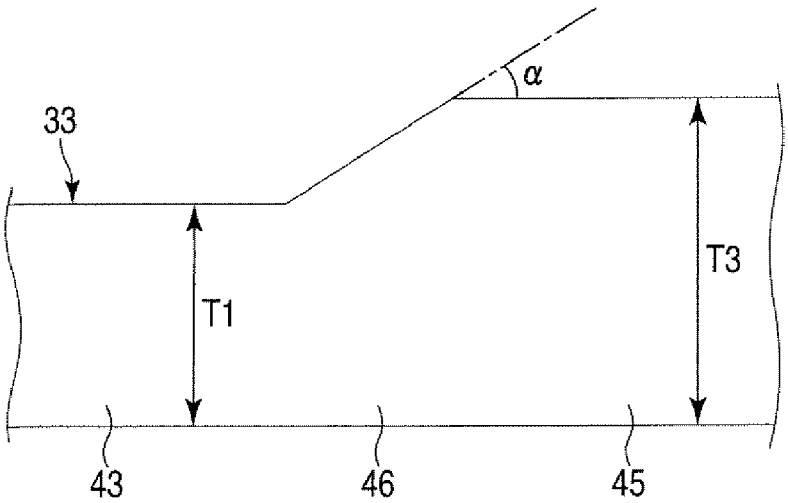
FIG. 5 is an exemplary view showing the region of the fin section shown in FIG. 4 encircled by line F5 in an enlarging manner.

As shown in FIG. 5, the fin thick part 45 is provided with an inclined section 46 a thickness of which is continuously changed between the fin thick part 45 and a region out of the fin thick part 45. The thickness of the inclined section 46 at a position decreases as the position is advanced in the direction intersecting the stream direction of the molten metal between the fin thick part 45 and the other part of the fin side section 42, 43. That is, the fin thick part 45 is not abruptly swelled in the direction intersecting the stream direction of the molten metal at, for example, a step, and is smoothly swelled at the inclined section 46.

The angle of inclination $\alpha$ of the inclined section 46 (see FIG. 5) is for example, 45° or less. Incidentally, the fin thick part 45 may be connected to the region out of the fin thick part 45 by the section formed into a curved surface by rounding off the edge in place of the inclined section inclined linearly.

As shown in FIG. 2, the product section 22 includes a product central section 51, and product side sections 52 and 53 provided on both sides of the product central section 51. The product central section 51 is a region straightly downstream from the biscuit section 31 in the stream direction of the molten metal, and is a downstream region of the fin central section 41.

Each of the product side sections 52 and 53 is a region out of the product central section 51, and is a downstream region of the fin side section 42, 43. As shown in FIGS. 2 and 7, a product thick part 55 connected to the fin thick part 45 is provided in a partial region of each of the product side sections 52 and 53 opposed to the fin thick part 45. The product thick part 55 is a thickness-increased part formed thicker than the thickness (that is, the standard thickness of the product section 22) of the product central section 51. The product thick part 55 is extended in the stream direction of the molten metal.

As shown in FIG. 2, the product thick part 55 is provided in only a part of each of the product side sections 52 and 53 in the stream direction of the molten metal. For example, when the cast product 2 is a housing component of a portable computer of the A4-size, in the product thick part 55, the length L1 thereof in the stream direction of the molten metal is, for example, about 30 mm. Incidentally, this numerical value does not limit the range of the present invention.

As shown in FIG. 2, the product thick part 55 includes an upstream end part 55*a* connected to the fin thick part 45, and a downstream end part 55*b* away from the fin thick part 45. As shown in FIG. 7, the thickness T4 of the upstream end part 55*a* of the product thick part 55 is the same as the thickness 13 of the fin thick part 45. The part between the upstream end part 55*a* and the downstream end part 55*b* is provided with a gently inclined surface in which a thickness of the product thick part 55 decreases in the direction toward the downstream side in the stream direction of the molten metal. The downstream end part 55*b* of the product thick part 55 has the same thickness T2 as the standard thickness of the product section 22 in the region away from the fin section 33. That is, the product thick part 55 gradually changes to the standard thickness of the product section 22.

As shown in FIG. 2, the width W2 of the product thick part 55 in the direction intersecting the stream direction of the molten metal is formed equal to the width W1 of the fin thick part 45 in the direction intersecting the stream direction of the molten metal. As shown in FIG. 7, the product thick part 55 is swelled in the direction in which the vertical wall section 26 rises from the bottom wall section 25. That is, the product thick part 55 is not formed on the outer surface side of the product, and is formed on the inner surface side of the product. Incidentally, the product thick part 55 is provided with an inclined section corresponding to the inclined section 46 of the fin thick part 45.

As shown in FIG. 9, the cast product 2 cast by using such a die 1 includes convex sections 61 formed in the product thick parts 55. The convex section 61 is swelled from the inner surface 58 in the cast product 2. That is, the convex section 61 does not appear on the outer surface 57 of the cast product 2. The cast product 2 may be used without being subjected to removal processing of the convex section 61, or may be used after being subjected, after casting, to removal processing for reducing the convex section 61 to the standard thickness by machining or the like.

Next, an example of a method of manufacturing the cast product 2 using the die 1 will be described below.

First, the die 1 described above is prepared, and the die 1 is set on the casting machine. Further, a raw material (for example, a magnesium alloy) is melted to obtain molten metal. Subsequently, the casting cycle is started. First, the movable die 7 is moved to be combined with the stationary die 6, and then the die 1 is clamped. Then, the molten metal is poured into a sleeve coupled to the inlet member 13, the injection plunger is forced out at a high speed, and the molten metal is pressed into the biscuit section 31 of the die 1.

When the solidification of the cast product 2 is advanced to a certain degree, the movable die 7 moves to open the die, and the cast product 2 is taken out of the die 1. As a result of this, one cycle of the die casting is completed. The cast product 2 taken out of the die 1 is subjected to removal processing of a surplus part, thereby obtaining a cast product 2 having the desired shape.

Next, the function of the die will be described below.

Figure 8:
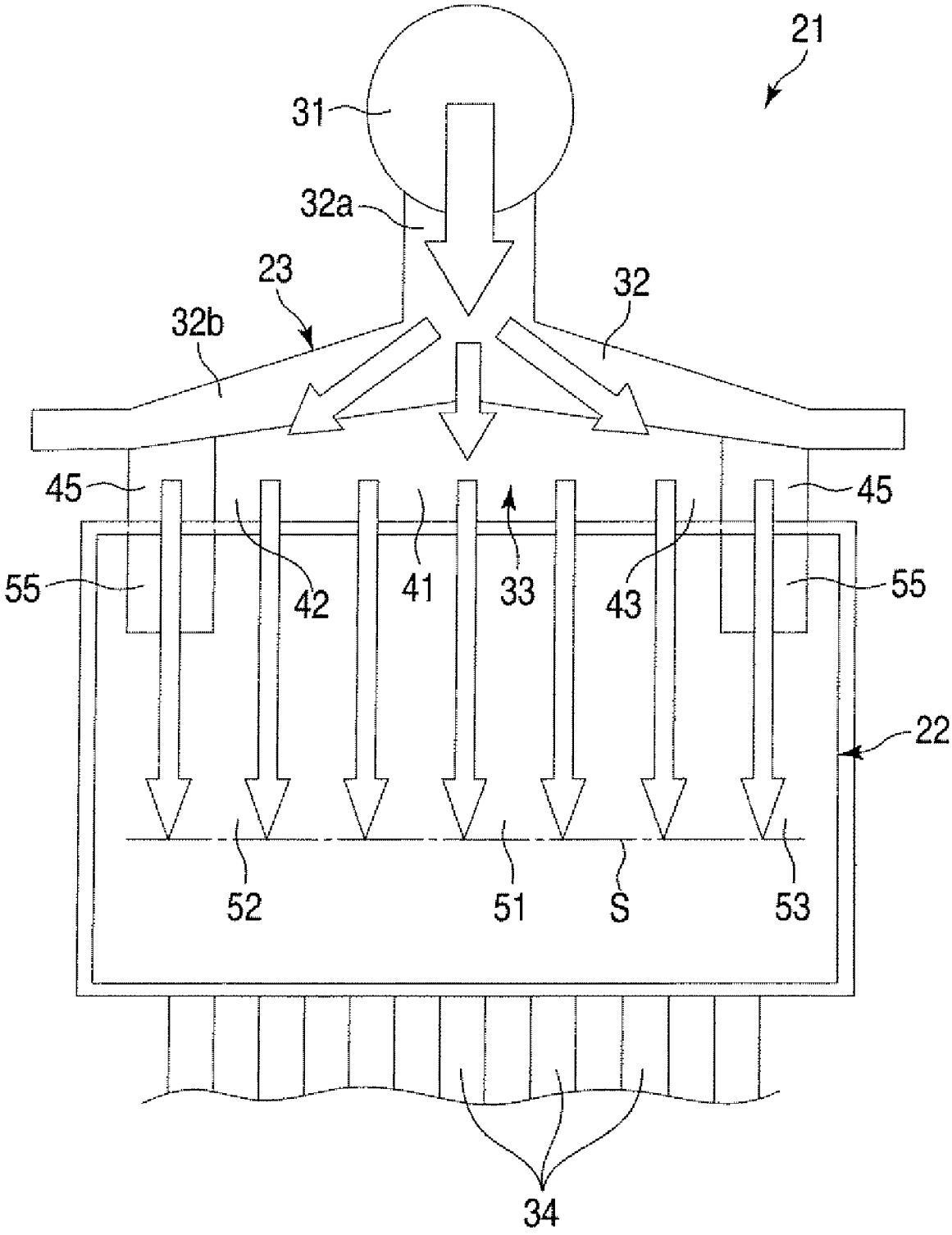
FIG. 8 is an exemplary view schematically showing the state of the molten metal flow in the internal space of the die shown in FIG. 2.

The outline arrows shown in FIG. 8 indicate the flow of the molten metal. The molten metal forced into the biscuit section 31 tries to flow toward the product section 22. Here, the fin side sections 42 and 43 are provided with the fin thick part 45. In the region provided with the fin thick part 45, the fluidity is higher than the fin central section 41. Thus, the molten metal does not intensively flow into the fin central section 41, and is appropriately distributed to the fin central section 41, and fin side sections 42 and 43 to flow. As a result of this, the flow of the molten metal becomes substantially uniform in the product central section 51, and the product side sections 52 and 53 as shown in FIG. 8.

The most part of the fin section 33 is connected to the bottom wall section 25 of the product section 22. As a result of this, the molten metal supplied from the fin section 33 directly enters the bottom wall section 25. Accordingly, the flow resistance at the injection time is relatively not large.

The alternate long and short dashed line S connecting the tips of the arrows in FIG. 8 exemplifies tip ends of the molten metal flow at a certain moment. In the die 1 according to this embodiment, the molten metal enters the product section 22 from only one edge section 22*a* thereof, and the balance (so-called flow balance) between the molten metal flow in the product central section 51 and the molten metal flow in the product side sections 52 and 53 is achieved by the fin thick part 45 and the product thick part 55. Thus, as shown in FIG. 8, the tips of the molten metal become substantially uniform throughout the entire width of the product section 22. As a result of this, the air inside the product section 22 can be pushed out in one direction to the overflow section 34, the air inside the product section 22 is hardly left therein, and the replacement of the air by the molten metal in the product section 22 is appropriately performed.

According to the die 1 configured as described above, it is possible to improve the flow balance of the molten metal, and reduce defective casting. That is, in the case where the fin side sections 42 and 43 are provided with the fin thick part 45 formed thicker than the thickness of the fin central section 41, it is possible to distribute the molten metal to the product central section 51, and the product side sections 52 and 53 without providing the delta section. That is, it is possible to straighten the flow balance of the product section 22 without providing the delta section.

In the case where the delta section can be done without, it is possible to avoid a situation in which the molten metal divided into parts at the delta section is again joined together, and in that process, the parts of the molten metal collide against each other. Accordingly, the gas inclusion in the product section 22 can be reduced, thereby making it possible to reduce defective casting. Further, against the delta section, the molten metal collides at a very high speed and at very high pressure, and hence fusion damage of die 1 is easily caused. That is, in the die 1 according to this embodiment in which a delta section is not provided, it is easily possible to prolong the service life as compared with a die provided with a delta section.

According to the casting method of manufacturing a cast product 2 using the die 1, it is possible to reduce the defective casting described above. Further, by using the die 1, it is possible to obtain a cast product 2 in which the defective casting is reduced.

In the case where the thickness of the fin section 33 is made equal to or larger than the thickness of the product section 22, the flow path cross section is abruptly narrowed at the time of the arrival of the molten metal at the product section 22, and hence there is the possibility of a defective flow of the molten metal being caused. On the other hand, as in this embodiment, in the case where the product thick part 55 connected to the fin thick part 45 is provided in the region of the product section 22 opposed to the fin thick part 45, it becomes hard for a defective flow of the molten metal to be caused at the boundary between the fin section 33 and the product section 22.

In recent years, there is a great demand for reduction in thickness of a cast product, and the thickness of the minimum thickness part of the fin section 33 is 0.4 mm or 0.3 mm in some cases. In such a case, when the cast product is taken out of the die, the rigidity of the cast product at the minimum thickness part is too weak to be stably taken out in some cases. On the other hand, according to the die 1 of this embodiment, the rigidity is enhanced by the convex section 61 formed by the fin thick part 45, and hence it is possible to stably take out the cast product 2 from the die 1.

When the upstream end part 55*a* of the product thick part 55 is formed in such a manner that the thickness thereof is identical with the thickness of the fin thick part 45, the upstream end part 55*a* being connected to the fin thick part 45, the flow of the molten metal is hardly disordered at the boundary between the fin thick part 45 and the product thick part 55, and hence it is possible to further reduce the defective casting.

The convex section 61 formed by the product thick part 55 is a surplus part having no function after the casting. When the product thick part 55 is formed in such a manner that the thickness thereof at a position becomes smaller as the position is advanced toward the downstream side in the stream direction of the molten metal, and the thickness thereof is the same as the standard thickness of the product section 22 in a region away from the fin section 33, the convex section 61 of the cast product 2 becomes smaller than the case where product thick part 55 is provided over the entire length of the product section 22.

In the case where the convex section 61 becomes small, the cast product 2 can be used without subjecting the convex section 61 to removal processing in the later step. When the convex section 61 becomes small, if the cast product 2 is used with the convex section 61 left unremoved, the space inside the housing is hardly limited by the convex section 61, and the convex section 61 does not largely hinder the weight reduction of the cast product 2.

In the case where the width W2 of the product thick part 55 equal to the same as the width W1 of the fin thick part 45, the flow of the molten metal is hardly disordered at the boundary between the fin thick part 45 and the product thick part 55, and hence it is possible to further reduce the defective casting.

In the case where the fin section 33 is connected to the bottom wall section 25 of the product section 22, and the product thick part 55 is swelled in the direction in which the vertical wall section 26 rises from the bottom wall section 25, the convex section 61 of the cast product 2 which is a surplus part is formed on the inner surface 58 of the product 2, and hence it is possible to incorporate the product 2 into the final product without removal processing of the convex section 61.

In the case where the fin thick part 45 is provided at the side edge section 42*a*, 43*a* of the fin section 33 in the stream direction of the molten metal, it is possible to effectively guide the molten metal to the side edge section of the product section 22 in which defective filling of the molten metal is liable to occur. As a result of this, it is possible to further reduce defective casting. Further, in the case where the convex section 61 is provided at the side edge section (i.e., corner section) of the cast product 2, the necessity of subjecting the convex section 61 to removal processing is further lowered.

In the case where the fin thick part 45 is provided with the inclined section 46 the thickness of which is continuously changed between the fin thick part 45 and the region out of the fin thick part 45, the flow of the molten metal is hardly disordered at the boundary between the fin thick part 45 and the part other than the part 45, and hence it is possible to further reduce the defective casting.

The effect of the embodiment described above is also effective for die casting using any one of a magnesium alloy, aluminum alloy, and zinc alloy as a material.

The die 1, the manufacturing method of the cast product 2, and the cast product 2 according to the embodiment of the present invention have been described above. However, the present invention is not limited to these. The fin thick part may be provided at a part other than the side edge section of the fin section. A plurality of the fin thick part may not necessarily be provided, and only one fin thick part may be provided. The fin section is not necessarily be formed symmetrical.

In the case where it is desired to increase the flow of the molten metal in a specific region, for example, in the case where a cast product provided with a large opening part on one of the right side and the left side is to be cast, it is possible to provide the fin thick part and the product thick part at a part corresponding to the specific region. The product thick part may be extended to the downstream end section of the product section. As to the fin thick part, and the product thick part, it is possible to appropriately set the number, and the size and shape in accordance with the length of the fan gate, and the product shape.

While certain embodiments of the inventions have been described, these embodiments have been presented by way of example only, and are not intended to limit the scope of the inventions. indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A die for die casting comprising:

a stationary die; and a movable die to be combined with the stationary die, wherein when the movable die is combined with the stationary die, a biscuit section by which molten metal is to be received from an infusion device of a casting machine, a product section which is a space in which a product is to be cast, a runner section which guides the molten metal from the biscuit section toward the product section, and a fin section which is provided between the runner section and the product section and has a thickness which decreases as a distance to the product section decreases are formed between the stationary die and the movable die, the product section includes an end part and other end part, the end part extending in a stream direction of the molten metal, and the other end part being positioned from the end part in a direction intersecting the stream direction of the molten metal in the product section, the fin section is entirely connected to the product section continuously from the end part to the other end part of the product section, and includes fin thick parts in areas on both sides of a region which the molten metal reaches when the molten metal straightly flows from the biscuit section in the stream direction of the molten metal, the areas being away from the region in the direction intersecting the stream direction of the molten metal, the fin thick parts being formed thicker than the region and extending from the runner section to the product section, and the product section includes product thick parts in areas located downstream of the fin thick parts in the stream direction of the molten metal, the product thick parts being space parts connected to the fin thick parts, respectively, and being formed thicker than a region of the product section connected to the region, and end parts of the product thick parts connected to the fin thick parts are formed to have the same thickness as the fin thick parts.

2. The die of claim 1, wherein each of the product thick pans has a thickness which decreases in a direction toward a downstream side of the molten metal and which equals, in a region away from the fin section, a thickness of the region which the molten metal reaches when the molten metal straightly flows from the biscuit section in the stream direction of the molten metal in the product section.

3. The die of claim 1, wherein widths of the product thick parts in the direction intersecting the stream direction of the molten metal are equal to a widths of the fin thick parts in the direction intersecting the stream direction of the molten metal.

4. The die of claim 3, wherein the product includes a bottom wall, a vertical wall rising from a peripheral edge part of the bottom wall, a convex part formed in the product thick parts and bulging from the bottom wall, the product being shaped like a box opened on one side, the product section includes a bottom wall section in which the bottom wall is to be cast, and a vertical wall section which rises from a peripheral edge part of the bottom wall section and in which the vertical wall is to be cast, and the bottom wall section is provided with the product thick parts, the fin section is connected to the bottom wall section of the product section, and the product thick parts are swelled in a direction in which the vertical wall section rises from the bottom wall section in such a manner that the convex parts bulge in the same direction as a direction in which the vertical wall rises with respect to the bottom wall.

5. The die of claim 4, wherein the fin section includes edge sections of the fin section extending in the stream direction of the molten metal on both sides of the region, the edge sections being away from the region of the fin section in the direction intersecting the stream direction of the molten metal, and the fin thick parts are provided at the edge sections, respectively.

6. The die of claim 5, wherein each of the fin thick parts includes an inclined section a thickness of which is continuously changed between the fin thick part and a region out of the fin thick part.

7. A method of manufacturing a cast product by die casting, comprising:

preparing a die including a stationary die, and a movable die to be combined with the stationary die, wherein when the movable die is combined with the stationary die, a biscuit section by which molten metal is to be received from an infusion device of a casting machine, a product section which is a space in which a product is to be cast, a runner section which guides the molten metal from the biscuit section toward the product section, and a fin section which is provided between the runner section and the product section and has a thickness which decreases as a distance to the product section decreases are formed between the stationary die and the movable die, the product section includes an end part and other end part, the end part extending in a stream direction of the molten metal, and the other end part being positioned from the end part in a direction intersecting the stream direction of the molten metal in the product section, the fin section is entirely connected to the product section continuously from the end part to the other end part of the product section, and includes a fin thick part in an area located away, in the direction intersecting the stream direction of the molten metal, from a region which the molten metal reaches when the molten metal straightly flows from the biscuit section in the stream direction of the molten metal, the fin thick part being formed thicker than the region and extending from the runner section to the product section, and the product section includes a product thick part in an area located downstream of the fin thick part in the stream direction of the molten metal, the product thick part being a space part connected to the fin thick part and being formed thicker than a region of the product section connected to the region;

combining the movable die with the stationary die; and infusing the molten metal into the biscuit section.

8. A die for die casting, comprising:

a stationary die; and a movable die to be combined with the stationary die, wherein when the movable die is combined with the stationary die, a biscuit section by which molten metal is to be received from an infusion device of a casting machine, a product section which is a space in which a product is to be cast, a runner section which guides the molten metal from the biscuit section toward the product section, and a fin section which is provided between the runner section and the product section and has a thickness which decreases as a distance to the product section decreases are formed between the stationary die and the movable die, the product section includes an end part and other end part, the end part extending in a stream direction of the molten metal, and the other end part being positioned from the end part in a direction intersecting the stream direction of the molten metal in the product section, the fin section is entirely connected to the product section continuously from the end part to the other end part of the product section, and includes a fin thick part in an area located away, in the direction intersecting the stream direction of the molten metal, from a region which the molten metal reaches when the molten metal straightly flows from the biscuit section in the stream direction of the molten metal, the fin thick part being formed thicker than the region and extending from the runner section to the product section, and the product section includes a product thick part in an area located downstream of the fin thick part in the stream direction of the molten metal, the product thick part being a space part connected to the fin thick part and being formed thicker than a region of the product section connected to the region.

9. The die of claim 8, wherein the product thick part includes an end part connected to the fin thick part, and the end part is formed to have the same thickness as the fin thick part.

* * * * *